US007518473B2

(12) United States Patent
Ni

(10) Patent No.: US 7,518,473 B2
(45) Date of Patent: Apr. 14, 2009

(54) METHODS FOR DESIGNING SWITCHABLE AND TUNABLE BROADBAND FILTERS USING FINITE-WIDTH CONDUCTOR-BACKED COPLANAR WAVEGUIDE STRUCTURES

(76) Inventor: Chi-Liang Ni, No.219-4, Sichang St., Wanhua District, Taipei City 108 (TW)

( * ) Notice: Subject to any disclaimer, the term of this patent is extended or adjusted under 35 U.S.C. 154(b) by 149 days.

(21) Appl. No.: 11/798,047

(22) Filed: May 9, 2007

(65) Prior Publication Data

US 2008/0278259 A1 Nov. 13, 2008

(51) Int. Cl.
*H01P 3/08* (2006.01)

(52) U.S. Cl. ..... 333/238; 333/246

(58) Field of Classification Search ..... 333/246, 333/238, 33, 260

See application file for complete search history.

(56) References Cited

U.S. PATENT DOCUMENTS 6,985,056 B2 * 1/2006 Kanno ..... 333/238
2007/0139133 A1 * 6/2007 Kwon et al. ..... 333/33

* cited by examiner

*Primary Examiner*—Stephen E Jones
(74) *Attorney, Agent, or Firm*—Muncy, Geissler, Olds & Lowe, PLLC

(57) ABSTRACT

This invention uses the structures of the finite-sized conductor-backed coplanar waveguides for designing broadband switchable and tunable signal filters. The design methods construct a plurality of configurations, which including waveguides, via holes, metallic posts, and conductor planes in the structures, for selecting, coupling, converting, and dissipating of the signals with specific electromagnetic modes and frequencies propagating through the structures. The dominant electromagnetic modes of the signals include Coplanar Waveguide Modes and Microstrip-Like Modes. The design methods thereby produce a plurality of filter types, such as bandstop filters, bandpass filters, multiband filters, etc. The design methods can apply to the structures with single and multi-layer dielectric and metallic materials, such as Integrated Circuits, Thin-film transistor Circuits, Low Temperature/High Temperature Co-fired Ceramics (LTCC/HTCC), PCB, and others. In addition, the design methods add switches to perform electrically controllable functions including frequency band selection and filter type selection. The design methods can also perform impedance matching of broadband signals by electrically tuning the values of inductance and capacitance in conjunction with the structures.

18 Claims, 7 Drawing Sheets

METHODS FOR DESIGNING SWITCHABLE AND TUNABLE BROADBAND FILTERS USING FINITE-WIDTH CONDUCTOR-BACKED COPLANAR WAVEGUIDE STRUCTURES

TECHNICAL FIELD OF THE INVENTION

This invention relates to the field of waveguides, filters, resonators and more specifically to switchable and tunable finite-width conductor-backed coplanar waveguide resonators and filters in conjunction with via holes and switches.

BACKGROUND OF INVENTION

The fast development of telecommunication services, such as Cellular phones, WiFi, WiMAX, RFID, Digital TV etc., faces different standards, spectrum allocations, and regulations. The portable products for these services move toward highly integrated forms as the technologies progress. To select a desirable signal or service on these products, we have been observing an increasing need exists for switchable and tunable filters for both broadband and multiband systems that are small in size, inexpensive, and easy to manufacture.

Highly integrated portable telecommunication products demand system miniaturization. The design of filters evolves with the miniaturization efforts of System On Package (SOP) and System On Circuit (SOC) technologies accordingly. From the SOP perspective, new generation of filters are assembled with other active and passive RF components, such as integrated circuits and antennas in Low Temperature Co-fired Ceramics (LTCC) packages. From the SOC perspective, active filters make steady progress as the high Q value on-chip inductors improve performance (Kuhn, et al "Dynamic Range Performance of On-Chip RF Bandpass Filter", IEEE Trans. On Circuits and Systems, Vol. 50, No. 10, October 2003, pp. 685-694). Recently, one of the efforts proposed Photonic Band Gap (PBG) or Electromagnetic Band Gap (EBG) structures on the substrates for the design of bandpass or bandstop filters or for the suppression of high-order harmonics (Y. Qian, V. Radisic, and T. Itoh, "Simulation and experiment of photonic band-gap structures for microstrip circuits", Asia-Pacific Microwave Conf., Hong Kong, December 1997, pp. 585-588). Other efforts adopted Defected Ground Structure (DSG) to create resonators on the ground plane. This approach resulted in that part of energy with frequencies at DSG resonators' frequencies is coupled to the ground plane and dissipated and constructed bandstop filters.

However, miniaturization does not directly meet the need for switchable and tunable filters for both broadband and multiband applications. Hereby, this invention follows the miniaturization trend and develops switchable and tunable filters based on some of prior arts:

(1) Finite-sized conductor-backed coplanar waveguides
(2) Vias or Via holes including connecting posts
(3) Switches (such as PIN diodes, FET transistors, Thin Film Transistors, MEMS etc.)

Coplanar waveguides was initially proposed by C. P. Wen in 1969 and has been under intensively investigation since this structure can be used for signal transmission and feeding, such as in Microwave Monolithic Integrated Circuits (MMICs) and antennas. For example, the inventor of this invention proposed of using coplanar waveguide for feeding high frequency patch antenna (D. Ni, et al, "Millimeter-Wave Generation and Characterization of a GaAs FET by Optical Mixing", IEEE Trans. On Microwave Theory and Techniques, Vol. 38, No. 5, May, 1990, pp. 608-614). Since the IC chips are generally attached onto finite-sized packages constructed by metallic and dielectric materials, finite-sized conductor-backed coplanar waveguides have also been studied extensively as shown in the following publications:

M. Riaziat, I. Feng, R. Majidi-Ahy, and B. Auld, "Single-Mode Operation of Coplanar Waveguides", Electronic Letters, Nov. 19, 1987, Vol. 23, No. 24, pp. 1281-1283;

C-C. Tien, C-K. C. Tzuang, S. T. Peng, and C-C. Chang, "Transmission Characteristics of Finite-Width Conductor-Backed Coplanar Waveguide", IEEE Trans. On Microwave Theory and Techniques, Vol. 41, No. 9, September 1993, pp. 1616-1624.

Recently, SOP efforts have integrated several active and passive components into millimeter-sized multi-layer LTCC packages, therein coplanar waveguides and the related waveguides once again under intensive modeling and simulation efforts.

Via holes have been playing a crucial roles in MMIC technology. Recently, via holes are also extensively used in multi-layer LTCC packages for connecting signal paths and ground planes across multi-layers. There are studies and measurements on the parasitic parameters, such as inductance and capacitance, as well as interference phenomena. The following publications describe some of these efforts:

K. L. Finch and N. G. Alexopoulos, "Shunt Posts in Microstrip Transmission Lines", IEEE Trans. On Microwave Theory and Techniques, Vol. 38, No. 11, November. 1990, pp. 1585-1594;

M. E. Goldfarb and R. A. Pucel, "Modeling Via Hole Grounds in Microstrip", IEEE Microwave and Guided Wave Letters, Vol. 1, No. 6, June 1991, pp. 135-137;

E. Laermans, J. D. Geest, D. Zutter, F. Olyslager, S. Sercu, and D. Morlion, "Modeling Differential Via Holes", IEEE Trans. On Advanced Packaging, Vol. 24, No. 3, August 2001;

In the studies listed above, Finch and Alexopoulos used via holes in conjunction with microstrip lines to construct bandpass filter at specific frequencies. Along with the development of multi-layer packages, such as LTCC, via holes are used in various areas:

(1) Isolation of signal waveguides from interference;
(2) Formation of walls of resonating cavities;
(3) Formation of connections for grounding;
(4) Use of via holes' parameters, such as length and radius, to adjust inductance and capacitance for the purpose of impedance matching.

The following publications and U.S. patents illustrate these usages of via holes: J. A. Ruiz-Cruz, Y. Zhang, K. A. Zaki, A. J. Piloto, and J. Tallo, "Ultra-Wideband LTCC Ridge Waveguide Filters", and U.S. Patent Documents: U.S. Pat. Nos. 5,689,216, 6,137,383, 7,053,729 B2, 7,113,060 B2, 7,142,074 B2, 7,170,373 B2.

Switchable and tunable filters take advantage of switching devices (such as PIN diodes, FET transistors, Thin film transistors, MEMS etc.) for connecting modules with different resonating frequencies. In the prior arts, designs of switchable and tunable coplanar filters used PIN diodes and MEMS for selecting or connecting several configurations of cavities or waveguide. Due to the fixed sizes and patterns of these configurations, the switchable types and tunable frequency range are limited. Others used magnetic of ferromagnetic materials, such as Barium Strontium Titanate Oxide (BSTO), for changing impedance and subsequently for tuning the frequencies. However, there are also limitations in frequency response due to the material characterization and manufacture cost. The following publications disclosed these prior arts: US Patent documents: U.S. Pat. Nos. 5,142,255, 5,693,429, 6,606,017, and 7,148,770.

SUMMARY OF INVENTION

The primary object of the present invention is to provide design methods for designing broadband filters by using finite-width conductor-backed coplanar waveguide structures which including configurations of signal waveguides, grounding waveguides, conductor-backed planes (or back conductors), and via holes with metallic posts so arranged that the selected coplanar waveguide modes are coupled and converted to the related electromagnetic modes, such as Microstrip-Like modes (MSL) and then dissipated to the ground through the configured structures; thereby the filtering functions, such as bandstop, bandpass, multibands, etc. are established.

A further object of the invention is to provide design methods for designing broadband filters by using finite-width conductor-backed coplanar waveguide structures, which can be implemented in various structures with single layer or a plurality of layers of metallic and dielectric materials, such as those used for building integrated circuits, thin film transistors, low temperature co-fired ceramics (LTCC), high temperature co-fired ceramics (HTCC), printed circuit boards (PCB), etc.

A specific object of the invention is to provide design methods for designing broadband switchable and tunable filters by using finite-width conductor-backed coplanar waveguide structures, which including configurations of signal waveguides, grounding waveguides, conductor-backed planes (or back conductors), and via holes with metallic posts; and further including additional switches between the ground waveguides and the conductor-back planes for electrically selecting the configuration of a specific filter type.

Another specific object of the invention is to provide design methods for designing broadband switchable and tunable filters by using finite-width conductor-backed coplanar waveguide structures, which including configurations of signal waveguides, grounding waveguides, conductor-backed planes (or back conductors), and via holes with metallic posts; and further including additional switches between the ground waveguides and the conductor-back planes for electrically selecting the configuration of a specific central frequency of a configured filter.

Another specific object of the invention is to provide methods for designing broadband switchable and tunable filters by using finite-width conductor-backed coplanar waveguide structures, which including configurations of signal waveguides, grounding waveguides, conductor-backed planes (or back conductors), and via holes with metallic posts; and further including additional switches between the ground waveguides and the conductor-back planes for electrically selecting the configuration for impedance matching of broadband signals.

DETAILED DESCRIPTION OF THE PREFERRED EMBODIMENT

Figure 1:
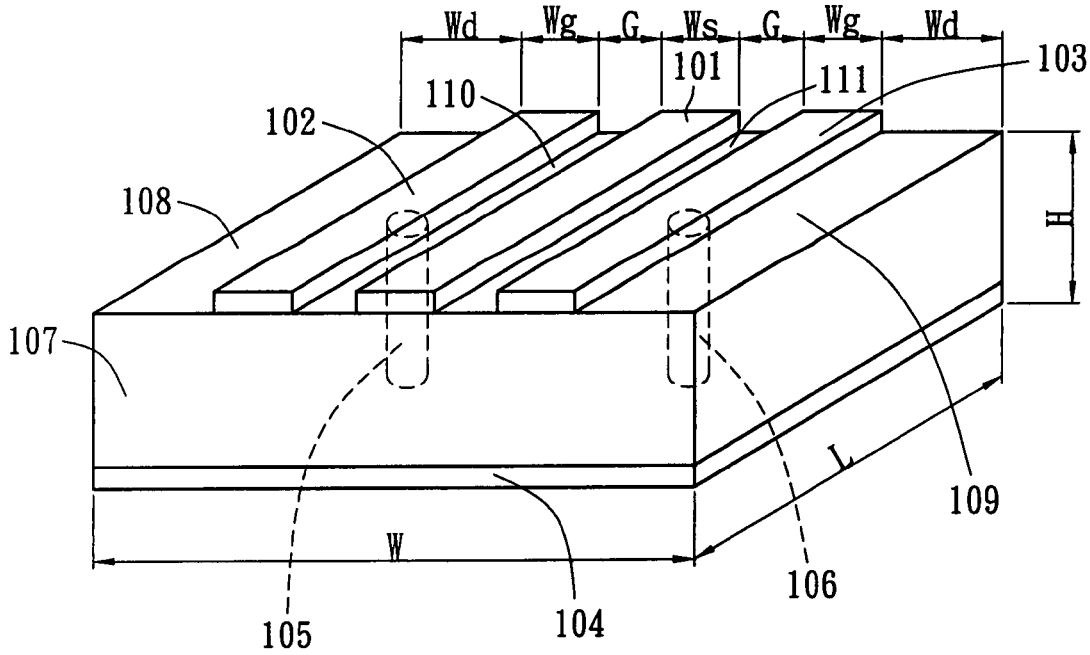
FIG. 1 illustrates a Finite-Width Conductor-Backed coplanar waveguide structures in this invention.
Figure 2:
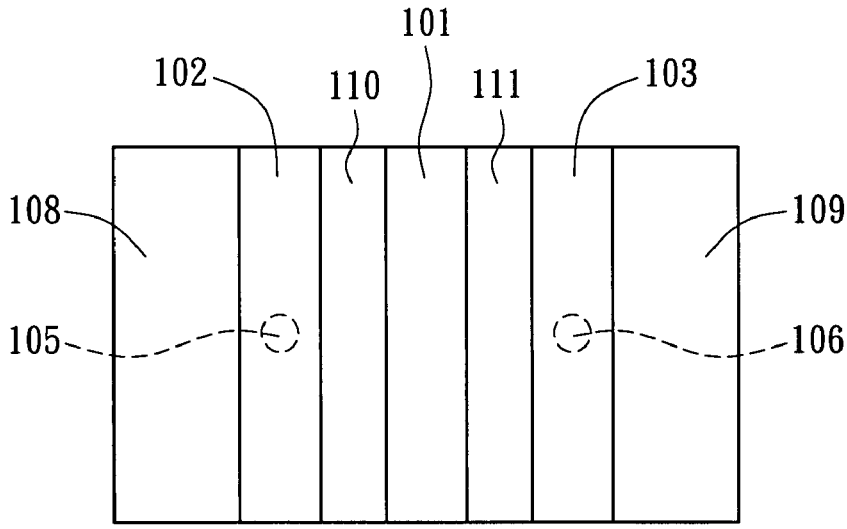
FIG. 2 is the top view of FIG. 1 and shows via holes.
Figure 3:
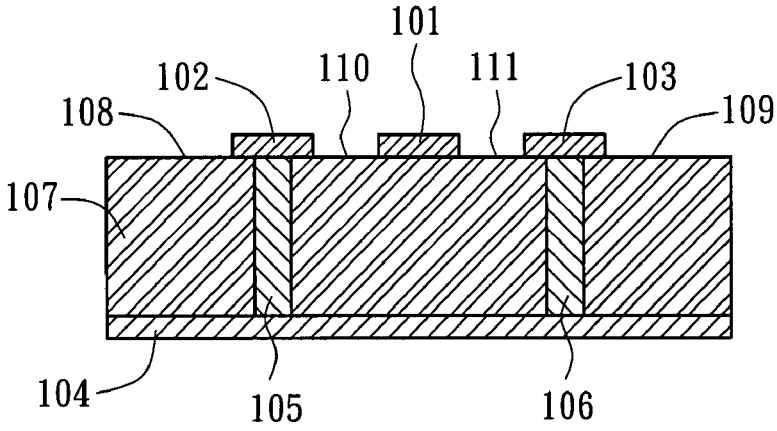
FIG. 3 is the cross sectional view of FIG. 1 and shows single layer of dielectric material, via holes including metallic connecting posts between metallic ground waveguides and metallic back conductor.
Figure 9:
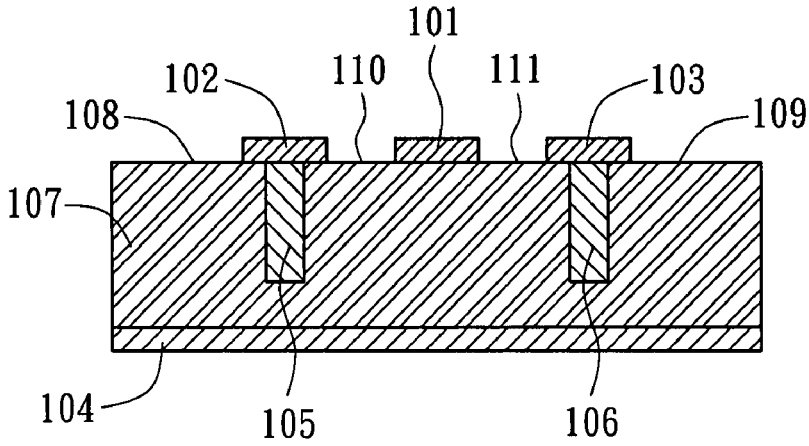
FIG. 9 shows cross sectional view of an alternative Finite-Width Conductor-Backed coplanar waveguide structure with the via holes including metallic connecting posts, which are not connected to the metallic back conductor.
Figure 10:
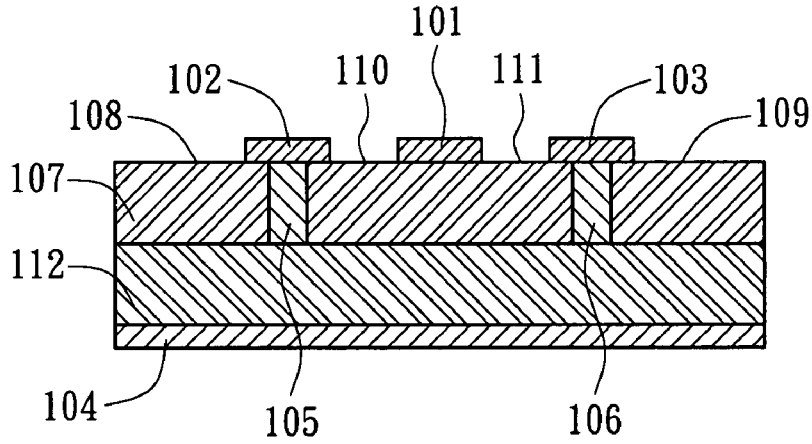
FIG. 10 shows cross sectional view of another alternative Finite-Width Conductor-Backed coplanar waveguide structure with two dielectric layers and the via holes including metallic connecting posts, which are not connected to the metallic back conductor.
Figure 12:
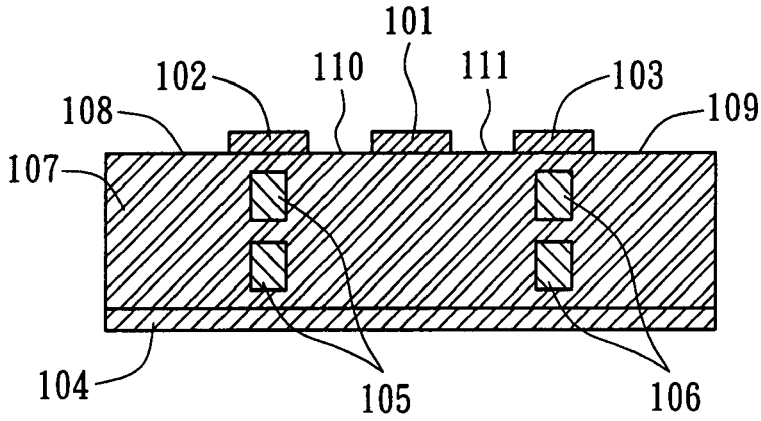
FIG. 12 shows cross sectional view of another alternative Finite-Width Conductor-Backed coplanar waveguide structure with the via holes including metallic connecting posts comprising multi-sectional and separated columns, which do not connect directly to the metallic ground waveguides and the metallic back conductor.

FIG. 1 illustrates a finite-width conductor-backed coplanar waveguide structures of this invention, FIG. 2 is the top view of FIG. 1; FIG. 3 is the cross sectional view of FIG. 1; herein 101 represents the metallic signal waveguide of the coplanar waveguide; 102 and 103 represent the metallic ground waveguides individually; 104 represents the metallic back conductor; 105 and 106 represent via holes including the metallic conducting posts between metallic ground waveguides 102,103 and the metallic back conductor 104; 107 represents the dielectric material; 108 and 109 represent individually the surfaces of the dielectric material without covering by metallic materials; 110 and 111 represent individually the surfaces of dielectric material 107 between metallic signal waveguide 101 and metallic ground waveguides 102 and 103; FIG. 1 shows the structures that comprising single layer dielectric material 107, and via holes including the metallic conducting posts 105 and 106, which connected directly to the metallic ground waveguides 102 and 103 and the metallic back conductor 104. The via holes including the metallic conducting posts 105 and 106 can be connected directly to the metallic ground waveguides 102 and 103 and the metallic back conductor 104 as shown in FIG. 3; or do not directly connect to the metallic back conductor 104 as shown in FIG. 9 and FIG. 10; or the via holes including the metallic conducting posts 105 and 106 comprising multi-sectional and separated columns, which do not connect directly to the metallic ground waveguides 102 and 103 and the metallic back conductor 104 as shown in FIG. 12. The metallic back conductor 104 can be a single layer of conductor or a plurality of layers of connected conductors.

The design methods for designing switchable and tunable broadband filters using finite-width conductor-backed coplanar waveguide structures, referring to FIGS. 1, 2, and 3, include the following steps:

(1). Based on the requirements of center frequency of a specific frequency band, number of electromagnetic modes, mode matching, mode coupling, and conversion of modes, the design methods specify length (L), width (W), and thickness (H) of the dielectric material 107, width (Ws) of the metallic signal waveguide 101, width (Wg) of the metallic ground waveguides 102 and 103, width (Wd) of the dielectric material without covering by the ground waveguides 108 and 109, distance (G) between the signal waveguide 101 and the ground waveguides 102 and 103, and relative dielectric constant (∈r) of the dielectric material for an optimal broadband operation.

(2). The design methods construct a configuration of a plurality of via holes including the radius or cross section and height of metallic connecting posts 105 and 106 at designated locations between the metallic ground waveguides 102 and 103, and metallic back conductor 104 for selecting the coupling modes, optimizing mode coupling efficiency, and defining the filter types; herein the via holes including the metallic conducting posts 105 and 106 can be connected directly to the metallic ground waveguides 102 and 103 and the metallic back conductor 104 as shown in FIG. 3, or do not directly connect to the metallic back conductor 104 as shown in FIG. 9 and FIG. 10; or the via holes including the metallic conducting posts 105 and 106 comprising multi-sectional and separated columns, which do not connect directly to the metallic ground waveguides 102 and 103 and the metallic back conductor 104 as shown in FIG. 12; in addition, the dielectric material between the metallic ground waveguides 102 and 103 and metallic back conductor 104 can be single layer dielectric material 107 as shown in FIG. 3 and FIG. 9, or two layers dielectric materials 107 and 112 as shown in FIG. 10, or more than two layer of dielectric materials (FIG. is not shown); thereby these different configurations provide a plurality sets of parameters for the definition of a specific type of filters.

(3). The design methods install a plurality of switches between the metallic ground waveguides 102, 103 and a plurality of the via holes including the metallic conducting posts 105 and 106; or between metallic back conductor 104 and a plurality of the via holes including the metallic conducting posts 105 and 106 in order to change the configuration for constructing different filter types, such as bandpass, bandstop, multiband, lowpass, highpass etc.

(4). The design methods install a plurality of switches between the metallic ground waveguides 102, 103 and a plurality of via holes including the metallic conducting posts 105 and 106; or between metallic back conductor 104 and a plurality of via holes including the metallic conducting posts 105 and 106 in order to change the configuration for tuning the center frequency of the configured filter.

The main differences of the invention from the prior arts of tunable and switchable filters are as follows:

(1). The configuration of the metallic signal waveguide 101 maintains unchanged when the filter performs switchable or tunable functions. This feature enables the metallic signal waveguide 101 processing signals across broader bandwidth than the configurations in the prior arts.

(2). The metallic ground waveguides 102, 103, metallic back conductor 104, and a plurality of the via holes including the metallic conducting posts 105 and 106 between these two sets of the metallic conductors construct a filter configuration, which comprises a flexible set of parameters for specifying different types of switchable and/or tunable filters.

(3). Since there is no switch directly connected to the metallic signal waveguide, the design methods simplify the filter structures and avoid signal and/or bias isolation problems existed in the prior arts.

The inductance introduced by the via holes including the metallic conducting posts 105, 106 can be calculated by the following formula:

$$L=(\mu_0/2\pi)\{H\times 1n[(H+(R^2+H^2)^{1/2})/RJ+3/2[R-(R^2+H^2)^{1/2}]\}$$

Here, L represents inductance, $\mu_0$ represents permeability, H represents the height of via hole metallic conducting post, R is the radius or cross section of via holes.

Figure 4:
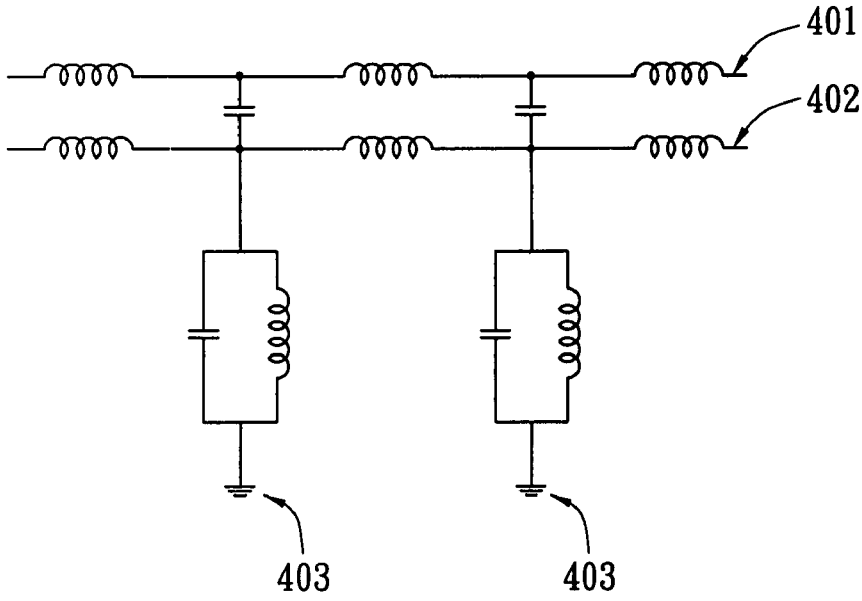
FIG. 4 is the equivalent circuit of the Finite-Width Conductor-Backed coplanar waveguide structure shown in FIG. 3.
Figure 11:
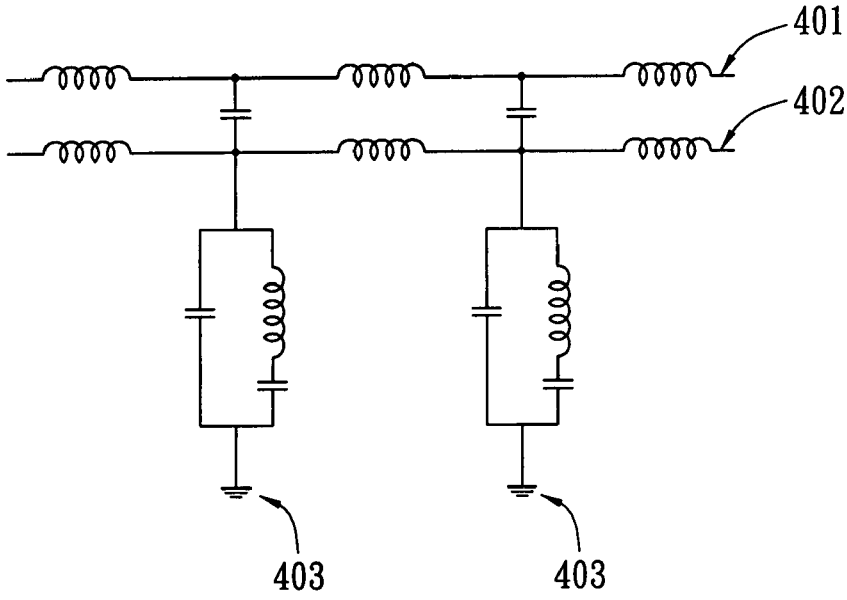
FIG. 11 is the equivalent circuit of the Finite-Width Conductor-Backed coplanar waveguide structure shown in FIG. 9.

FIG. 4 shows the equivalent circuit of FIG. 3, wherein a plurality of the via holes including the metallic conducting posts 105, 106 are directly connected to the metallic ground waveguides 102, 103 and the metallic back conductor 104. In FIG. 4, 401 represents the equivalent circuit of the metallic signal waveguide (101); 402 represents the equivalent circuit of the metallic ground waveguide (102, 103); 403 represents the equivalent circuit of back conductor (104); the configuration in FIG. 3 produces a plurality of resonating cavities, which are represented by LC circuits in FIG. 4. These cavities absorb part of the energy, which are coupled from the metallic signal waveguide based on the resonating frequencies of the cavities, and dissipate the energy to the metallic back conductor. As an illustration, the above configuration produces a bandstop filter. As another illustration, the design methods can also construct a different configurations, which combining two bandstop filters for forming a bandpass filter; further, FIG. 11 shows the equivalent circuit of FIG. 9 and FIG. 10, wherein the via holes including the metallic conducting posts 105 and 106 do not directly connect to the metallic ground waveguides 102, 103 and the metallic back conductor 104. The capacitance introduced by the gaps between post columns and the back conductor can be calculated directly from the area of cross section and dielectric constant.

Figure 5:
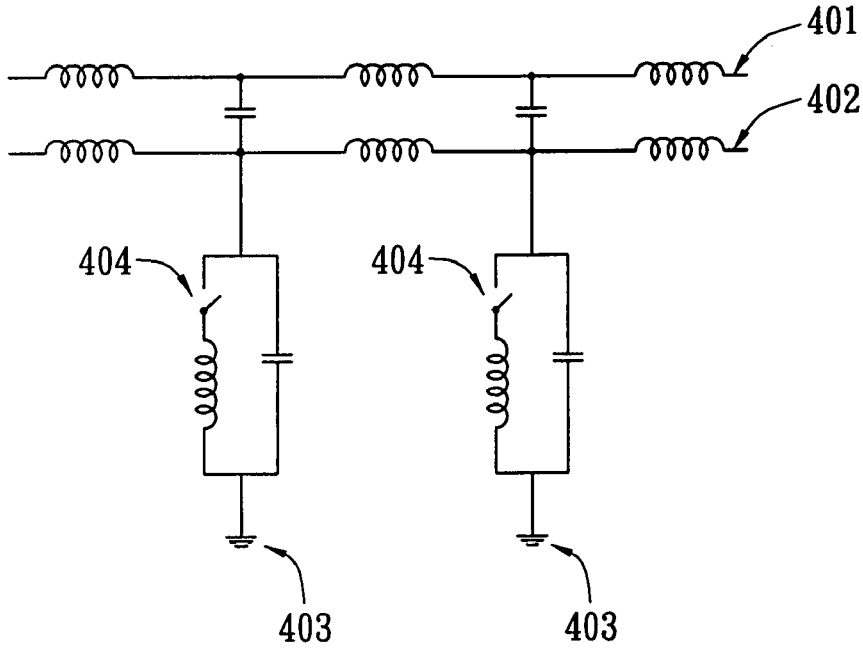
FIG. 5 is the equivalent circuit shown in FIG. 4 with additional switches connecting via holes including metallic connecting posts and metallic ground waveguides.

FIG. 5 shows the equivalent circuit of FIG. 4 with additional switches; 401 represents the equivalent circuit of metallic signal waveguide (101); 402 represents the equivalent circuit of metallic ground waveguide (102, 103); 403 represents the equivalent circuit of the back conductor (104); 404 represents a plurality of switches. Under normal operation, the switching devices have parasitic inductance and capacitance; in addition, they need biases, i.e., external voltage and current supplies, in order to change and to maintain connecting or disconnecting status. The configurations in the prior arts of switchable and tunable filters connect directly the switches onto the signal transmission conductors (referred as metallic signal waveguide 401 in this invention). The direct connection will result in characteristic drift of the filters and due to signal isolation problems, which increase the cost of manufacture. The design methods of this invention connect a plurality of switches to the metallic ground waveguides 102, 103, and therefore avoid the induced problems and cut down significant part of manufacture cost.

Based on FIG. 2, the design methods illustrate hereby an embodiment of designing a GaAs MMIC broadband bandstop filter. The design methods specify the ratios of length (L), width (W), and thickness (H) of dielectric material 107, the width (Ws) of metallic signal conductor 101, the width (Wg) of metallic ground conductors 102 and 103, the width (Wd) of dielectric material without covering by ground conductors 108 and 109, the distance (G) between signal conductor 101 and ground conductors 102 and 103, and relative dielectric constant (∈r) as follows:

L: 10
W: 15
H: 10
Ws: 1
Wg: 3
Wd: 3
G: 3
∈r: 12.9

Figure 6:
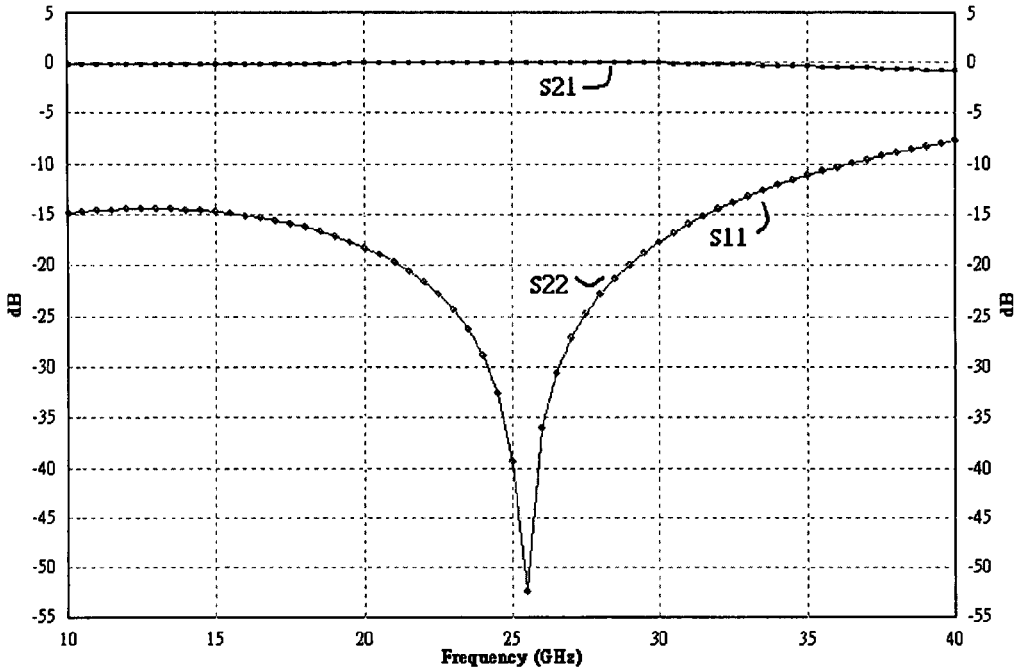
FIG. 6 is the Scattering parameters: $S_{21}$, $S_{11}$, and $S_{22}$ of GaAs finite-width conductor-backed coplanar waveguide without via holes.
Figure 7:
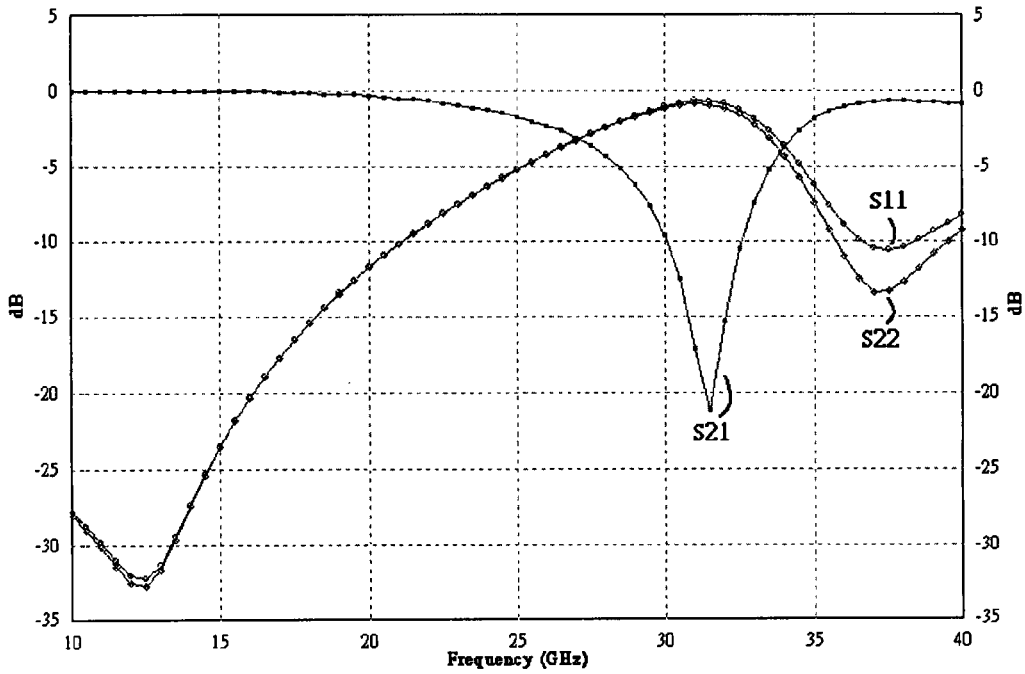
FIG. 7 is the Scattering parameters: $S_{21}$, $S_{11}$, and $S_{22}$ of GaAs bandstop filter based on finite-width conductor-backed coplanar waveguide structures as shown in FIG. 2.
Figure 8:
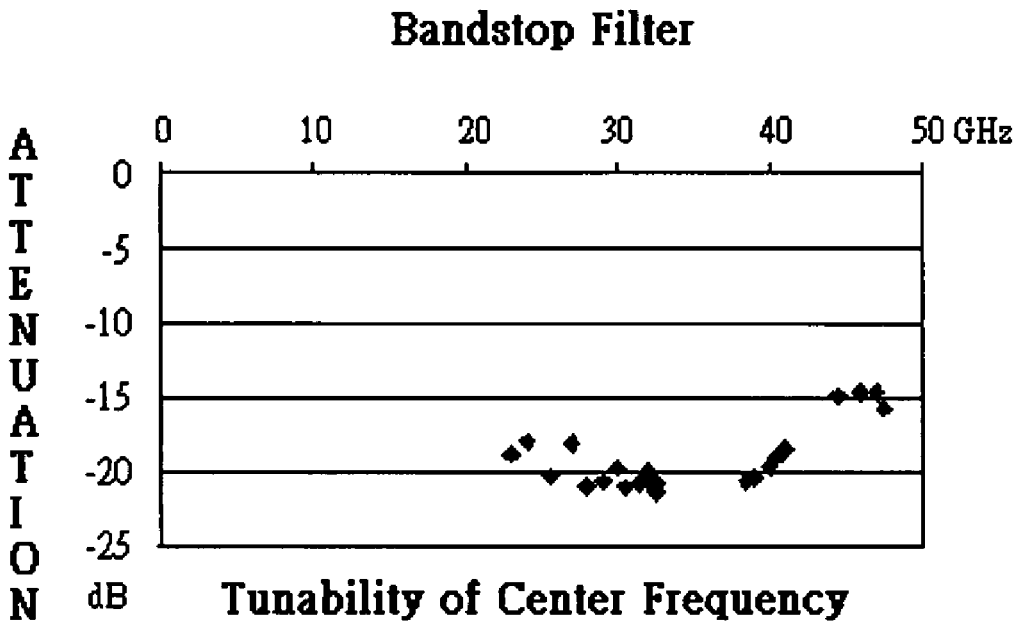
FIG. 8 shows the frequency response of GaAs tunable bandstop filter. Each data point represents a specific configuration.

FIG. 6 shows the scattering parameters: $S_{21}$, $S_{11}$, and $S_{22}$ of the GaAs coplanar waveguide without via holes. The FIG. shows a single electromagnetic mode propagating through the finite-width conductor-backed coplanar waveguide, and the signal strength $S_{21}$ indicates very low attenuation. FIG. 7 shows the scattering parameters: $S_{21}$, $S_{11}$, and $S_{22}$ after a plurality of the via holes including the metallic conducting posts 105 and 106 connected directly to the metallic ground waveguides 102 and 103 and the metallic back conductor 104. The FIG. shows a bandstop filter with center frequency attenuated more than 20 dB. FIG. 6 can be viewed as the switches connecting via holes including the metallic conducting posts 105 and 106 are open or disconnected from the metallic ground waveguides 102 and 103; FIG. 7 can be viewed as the switches connecting via holes including the metallic conducting posts 105 and 106 are closed or connected to the metallic ground waveguides 102 and 103. FIG. 8 shows the tuning range and attenuation of the center frequencies for a plurality of the configurations. The tunable range exceeds 30 GHz. FIG. 7 and FIG. 8 illustrates the broadband characteristics of this invention. FIG. 8 can be viewed as the frequency response of a tunable filter as the configuration changed from one to another by electrically controlling a plurality of switches.

In summary, the design methods of the invention includes the following steps: the design methods take the conditions of the center frequency of the designated frequency band, number of electromagnetic modes, mode matching, mode coupling, and conversion of modes for determining the ratios of length (L), width (W), and thickness (H) of the dielectric material, width (Ws) of metallic signal waveguide, width (Wg) of metallic ground waveguides, width (Wd) of dielectric material without covering by metallic ground waveguides, distance (G) between metallic signal waveguide and metallic ground waveguides; then construct a specific configuration, which are formed by the metallic ground waveguides, the metallic back conductor, and a plurality of the via holes including the metallic conducting posts, for building the filter with desirable characteristics, such as center frequency, type, bandwidth etc.; further, the design methods install a plurality of switches between the metallic ground waveguides and a plurality of the via holes including the metallic conducting posts to facilitate switchable and tunable capabilities of these filters.

Although the present invention has been described in the detailed embodiment, a myriad of changes, variations, alterations, transformations and modifications may be suggested to one skilled in the art, and it is intended that the present invention encompass such changes, variations, alternations, transformations and modifications that fall within the spirit and scope of appended claims.

What is claimed is:

1. A design method for designing broadband filters using finite-width conductor-backed coplanar waveguide structures comprising:

Determining the ratios of length (L), width (W), and thickness (H) of dielectric material, the width (Ws) of metallic signal waveguide, the width (Wg) of metallic ground waveguides, the width (Wd) of dielectric material without covering by metallic ground waveguides, the distance (G) between metallic signal waveguide and metallic ground waveguides based on center frequency of the desirable frequency band, number of electromagnetic modes, mode matching, mode coupling, and conversion efficiency of modes;

Specifying a configuration of via holes including the radius or cross section and height of metallic connecting posts and the locations of these via holes between the metallic ground waveguides, and metallic back conductor, for producing a plurality of equivalent resonant cavities with specific resonant frequencies; therefore part of the energy of a plurality of electromagnetic modes with the specific frequencies coupled from the metallic signal waveguide to the metallic ground waveguide, and subsequently converted to a different plurality of electromagnetic modes conducted through the conducting posts of the via holes, and dissipated to the metallic back conductor, thereby establishing the filtering effect.

2. The method as claimed in claim 1, wherein the metallic material can be any materials, which conducting electrical signals, and the dielectric material can be any materials, which propagating electromagnetic waves.

3. The method as claimed in claim 1, wherein the design method does not limit to design filters for a specific frequency range.

4. The method as claimed in claim 1, wherein the method does not limit to design filters of a specific type.

5. The method as claimed in claim 1, wherein the metallic ground waveguides and metallic back conductor do not limit to be used only in conjunction with the filters.

6. The method as claimed in claim 1, wherein the dielectric materials between metallic ground waveguides and metallic back conductor can be single layer or a plurality of layers; and can be one type or a plurality of types.

7. The method as claimed in claim 1, wherein the via holes including metallic conducting posts can directly connect to the metallic ground waveguide and the metallic back conductor, or do not contact with the metallic ground waveguide and the metallic back conductor.

8. The method as claimed in claim 1, wherein the via holes including metallic conducting posts can be a plurality of separated columns of posts with different cross sections.

9. The method as claimed in claim 1, wherein the metallic back conductor can be a single layer of conductor or a plurality of layers of connected conductors.

10. The method as claimed in claim 1, wherein the designed waveguides and filters can be integrated with other passive and active components to form a subsystem.

11. The method as claimed in claim 10, wherein the designed waveguides and filters can be used for impedance matching in the integrated subsystem.

12. A design method for designing switchable and tunable broadband filters using finite-width conductor-backed coplanar waveguide structures comprising:

Determining the ratios of length (L), width (W), and thickness (H) of dielectric material, the width (Ws) of metallic signal waveguide, the width (Wg) of metallic ground waveguides, the width (Wd) of dielectric material without covering by metallic ground waveguides, the distance (G) between metallic signal waveguide and metallic ground waveguides based on center frequency of the desirable frequency band, number of electromagnetic modes, mode matching, mode coupling, and conversion efficiency of modes;

Specifying a configuration of via holes including the radius or cross section and height of metallic connecting posts and the locations of these via holes between the metallic ground waveguides, and metallic back conductor, for producing a plurality of equivalent resonant cavities with specific resonant frequencies; therefore part of the energy of a plurality of electromagnetic modes with the specific frequencies coupled from the metallic signal waveguide to the metallic ground waveguide, and subsequently converted to a different plurality of electromagnetic modes conducted through the conducting posts of the via holes, and dissipated to the metallic back conductor, thereby establishing the filtering effect; further;

Installing a plurality of switches between metallic ground waveguides and the via holes including metallic connecting posts or between the via holes including metallic connecting posts and the metallic back conductor for connecting or disconnecting a plurality of the via holes including metallic connecting posts for changing the configuration and subsequently for changing the filter characteristics.

13. The method as claimed in claim 12, wherein the plurality of switches are not limited to specific physical locations.

14. The method as claimed in claim 12, wherein the plurality of switches are not limited to specific types.

15. The method as claimed in claim 12, wherein the plurality of switches can change the configuration and subsequently change the center frequency of the filter and thereby construct a tunable filter.

16. The method as claimed in claim 12, wherein the plurality of switches can change the configuration and subsequently change characteristics of the filter and thereby construct a switchable filter.

17. The method as claimed in claim 12, wherein the designed waveguides and filters can be integrated with other passive and active components to form a subsystem.

18. The method as claimed in claim 17, wherein the designed waveguides and filters can be used for impedance matching in the integrated subsystem.

* * * * *